US005199844A

United States Patent [19]

Gilmore, Jr. et al.

[11] Patent Number: 5,199,844

[45] Date of Patent: * Apr. 6, 1993

[54] QUICK-DISCONNECT COUPLING FOR A MACHINE HAVING A BOOM AND A STICK

[75] Inventors: Charles P. Gilmore, Jr., Mondamin, Iowa; James J. Maynard, Marcellus, N.Y.

[73] Assignee: Gilmore Transporation Services, Inc., Missouri Valley, Iowa

[ * ] Notice: The portion of the term of this patent subsequent to Jul. 3, 2007 has been disclaimed.

[21] Appl. No.: 874,539

[22] Filed: Apr. 27, 1992

Related U.S. Application Data

[63] Continuation of Ser. No. 547,943, Jul. 2, 1990, Pat. No. 5,108,252, which is a continuation-in-part of Ser. No. 177,360, Apr. 4, 1988, Pat. No. 4,938,651.

[51] Int. Cl.[5] ..... B66C 23/56

[52] U.S. Cl. ..... 414/694; 403/13; 403/339; 414/723

[58] Field of Search ..... 414/694, 722, 723, 727, 414/729, 685; 403/340, 364, 339, 43, 45, 48, 14, 13; 411/107, 432

[56] References Cited

U.S. PATENT DOCUMENTS

| | | | |
|---|---|---|---|
| 2,831,544 | 4/1958 | Dunn et al. . | |
| 3,556,323 | 1/1971 | Heimmermann . | |
| 3,809,250 | 5/1974 | Pilch . | |
| 3,934,738 | 1/1976 | Arnold . | |
| 3,977,548 | 8/1976 | McCannon et al. . | |
| 3,985,249 | 10/1976 | Aker et al. . | |
| 4,142,642 | 3/1979 | Myers | 414/723 |
| 4,208,163 | 6/1980 | Holmqvist . | |
| 4,214,840 | 7/1980 | Beales . | |
| 4,253,793 | 3/1981 | Braml . | |
| 4,355,945 | 10/1982 | Pilch . | |
| 4,373,852 | 2/1983 | Maurer . | |
| 4,571,146 | 2/1986 | Eriksson . | |
| 4,586,867 | 5/1986 | Stafford . | |
| 4,636,135 | 1/1987 | Bancon | 403/325 |
| 4,643,631 | 2/1987 | Maurer et al. . | |
| 4,664,588 | 5/1987 | Newell et al. . | |
| 4,666,049 | 5/1987 | Gilmore, Jr. . | |
| 4,674,945 | 6/1987 | Hulden . | |
| 4,693,384 | 9/1987 | Gilmore, Jr. . | |
| 4,761,113 | 8/1988 | Smith et al. . | |
| 4,881,573 | 11/1989 | Durant et al. . | |
| 4,938,651 | 7/1990 | Gilmore, Jr. et al. | 414/694 |
| 5,108,252 | 4/1992 | Gilmore, Jr. et al. | 414/694 |

OTHER PUBLICATIONS

Wain-Roy Quick Change Toolhitch Coupler System (May 1986).

Caterpillar Versa-Link system brochure (1987).

American Coupler Systems brochure (Apr. 1983).

Balderson, Products for Caterpillar Machines brochure (Apr. 1979).

Wain-Roy Toolhitch Connector System (Nov. 1977).

*Primary Examiner*—David A. Bucci
*Assistant Examiner*—Donald W. Underwood
*Attorney, Agent, or Firm*—Lloyd D. Zickert

[57] ABSTRACT

A heavy-duty machine, such as an excavator, having a boom mounted for motion in a generally vertical arc, a stick mounted onto the distal end of the boom, and a tool mounted at the distal end of the stick. The stick is connected to the boom by a quick-disconnect coupling including a coupling member that is rockably mounted at the distal end of the boom and a coupling member mounted at the proximal end of the stick. A grab hook on the boom coupling member is used to pick up the stick by hooking onto a grab pin of the stick coupling member. A set of rack gear teeth on the boom coupling member intermesh with a corresponding set of rack gear teeth on the stick coupling member, and these eliminate play between the stick and boom. A quick-disconnect hydraulic coupling including a female coupling element mounted on the boom coupling member with a remotely operable locking means, and a male coupling element mounted on stick coupling member provide automatic coupling of hydraulic lines between the boom and stick when the coupling members are brought together.

21 Claims, 11 Drawing Sheets

10
12
14
16
18
20
22
24
26
28
30
32
34
36
38
40
42
44
46
48
50
51
52
58
60
62
104
116
56

40
110
112
114
108
112
104
50
106
110
104
120
124
126
102
84
120
122
116
118
86
100
82
96
94
104
92
86
90
80
76
90
88
92
78
82
72
68
66
72
70
64
64
64
36
74
58
66
68
51
60
62
70
60
62
58
98
54
52
30
56
54
38

QUICK-DISCONNECT COUPLING FOR A MACHINE HAVING A BOOM AND A STICK

This application is a continuation of application Ser. No. 547,943, filed Jul. 2, 1990, for Gear Lock Quick-Disconnect Mechanism for Articulated Machine, now U.S. Pat. No. 5,108,252, which was a continuation-in-part application of application Ser. No. 177,360 filed Apr. 4, 1988, now U.S. Pat. No. 4,938,651.

DESCRIPTION

This invention relates to heavy machines, such as hydraulic excavators, and is more particularly directed to machines of the type having a boom, a stick having a tool attachment, and a quick-disconnect coupling between the boom and stick, wherein one or more sticks may be quickly interchangeably connectable to the boom.

BACKGROUND OF THE INVENTION

A typical excavator or similar heavy equipment apparatus includes a boom and a stick rockably mounted on the boom, with a bucket, blade, shear, grapple, fork, or other tool attached to the end of the stick. Hydraulic cylinders are mounted on the boom to raise or lower the stick in the same plane. A tool cylinder connected between the tool and the stick operates the tool, i.e., raises or lowers the bucket, opens or closes the shear, etc.

Different tools are often required for an operation. If these are to be joined to the same excavator or other similar apparatus, it is required to remove the tool from the stick, or to remove the stick from the boom to substitute a different tool or stick. The stick is taken off the boom to substitute a different stick, for example, a stick of a different length or width, or a stick having a different tool formed unitarily on it. A pivot pin is driven from the articulated joint between the distal end of the boom and the stick, and an eye pin is driven from the connection of the stick with the stick cylinder rod. Then the substitute stick has to be manipulated, the pivot pin driven back into place, and the eye pin driven into place. After that, hydraulic lines have to be run from the excavator body to the tool cylinder. Aligning the stick with the boom is difficult. This operation can require the work of a crew of several skilled workmen and can consume an hour or more.

Quick-disconnect mechanisms have been well known for the tool end of the stick, for example, to facilitate the interchange of buckets of different sizes or configurations. This has been especially proposed with respect to backhoe attachments in the field. However, no such satisfactory quick-disconnect mechanism has been known for use between the stick and the boom.

It is often required to use attachments with integral stick and tool configurations, for example, a large shears employed for the recycling of steel scrap. It is well accepted now that one-piece shear-stick arrangements are far superior to a combination of a stick and an interchangeable or pin-on shear. This is so, at least in part, because of the structural soundness of the shear-stick and the relatively low installation and removal time requirements of an integral shear-stick. In a steel scrapping operation, it is often necessary to change from a shear to a grapple, clamshell, or other attachment quickly and without a crew in attendance. However, this cannot be done unless there are some means provided for the quick connecting and disconnecting of the stick to the boom of the excavator machine employed for that purpose.

If quick-disconnect mechanisms presently used on wheel loaders between the loader arms and buckets were used between the boom and the stick, the stick may tend to wobble somewhat because of play in the mechanism amplified over the length of the stick.

OBJECTS AND SUMMARY OF THE INVENTION

Accordingly, it is an object of this invention to provide a heavy-duty machine having a boom with stick-tools connectable to the boom which avoids the drawbacks of the prior art, and which permits the quick interchangeability of various stick configurations.

It is another object of this invention to provide a machine with a suitable quick-disconnect mechanism wherein the sticks can be interchanged with a minimum crew size, without need to manipulate the sticks to effect the connecting or disconnecting, and which gives a secure stable mounting.

In accordance with an aspect of this invention, a heavy-duty machine, such as a hydraulic excavator, has a base, an overcarriage swingably mounted on the base and including a drive for swinging the overcarriage in a generally horizontal plane, a boom having its proximal end pivotally mounted on the overcarriage for motion in a generally vertical arc, a boom cylinder or equivalent means for raising and lowering the boom in its arc, a stick having its proximal end rockably mounted at the distal end of the boom, with a tool being mounted at the distal end of the stick, and with a stick cylinder or other equivalent means for rocking the stick relative to the boom. Between the boom and stick is a quick-disconnect coupling including a coupling member at the distal end of the boom. A mating coupling member is affixed to the proximal end of the stick for permitting the stick to be removably joined to the boom.

The stick coupling member includes a transverse grab pin and male aligner member, while the boom coupling member includes a grab hook for engaging the grab pin, with the hook being pivotable on the grab pin. The boom coupling member also has a pair of female aligner members disposed laterally opposite each other for receiving the male aligner member on the stick coupling member to align the coupling members into mating engagement. When the coupling members have been aligned by the male and female aligners, a locking mechanism will draw the coupling members together into tight engagement with one another. The grab pin slides on the grab hook. An arrangement of rack gear teeth on the coupling members engage one another and prevent lateral play or wobble.

The locking mechanism may take various forms. One form is illustrated and described as including transversely extending pins on one of the coupling members remotely operable to be driven toward each other and to coact with mating slots on the other of the coupling members. Another form of locking mechanism includes a plurality of bolt/nut devices where the bolt is mounted on one of the coupling members and the nut is mounted on the other of the coupling members. One of the bolt or nut elements is fixed and the other is rotatable and driven by a remotely operable motor. Further, at least one of the bolt or nut elements is resiliently mounted to absorb shock when the two coupling members are brought together.

Another feature of the invention is in the use of a quick-disconnect hydraulic coupling wherein a male coupling element is provided on one of the coupling members and a female coupling element is provided on the other of the coupling members. A locking device is provided for locking the coupling elements and is remotely operable to selectively lock and unlock the hydraulic coupling.

The grab hook on the boom coupling member may be formed from a pair of arms or a solid member. Where it is formed of a pair of arms, the terminal ends of the arms are closer together than the base portion of the arms so as to enable hooking up to the grab pin when the boom and stick are not in direct alignment with each other. Where the grab hook is solid, the portion connected to the base has a width which assists in alignment of the coupling members and the distal end of the grab hook is narrower to facilitate engagement with the grab pin.

It is therefore a further object of the present invention to provide a quick-disconnect coupling to be used between a boom and stick of a heavy-duty machine so that sticks may be easily interchanged and which includes quick-disconnect hydraulic couplings to facilitate the connecting and disconnecting of hydraulic lines between the boom and the stick.

Another object of the present invention is to provide a quick-disconnect coupling for use between a boom and a stick of a heavy-duty machine and which includes a positive locking mechanism for locking the coupling members together and which is remotely operable and where the locking mechanism includes a bolt mounted on one of the coupling members of the quick-disconnect coupling and a nut mounted on the other of the coupling members, one of the nut or bolt being fixed and the other being rotatable.

A still further object of the present invention is in the provision of a quick-disconnect coupling for use between a boom and a stick of a heavy-duty machine and which includes mating coupling members respectively on the boom and stick together with a grab pin on one of the coupling members and a grab hook on the other coupling member to facilitate the interconnection of the coupling members.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figures 1, 5:
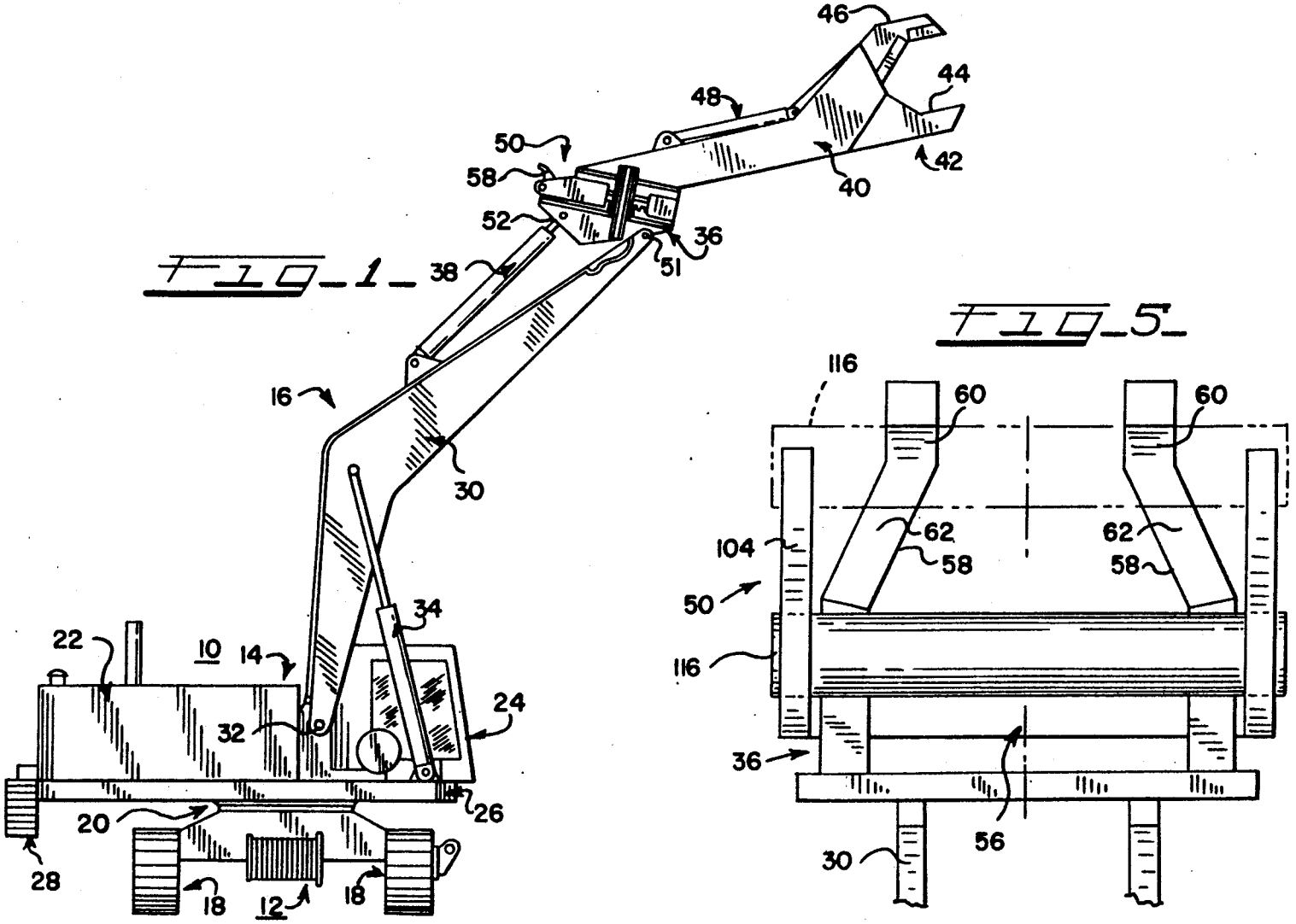
FIG. 1 is an elevational view of a heavy-duty machine according to one embodiment of this invention.
FIG. 5 is a sectional view taken at line 5—5 of FIG. 3.

With reference to the drawing, and initially to FIG. 1 thereof, a crane-type excavator or heavy-duty machine 10 is shown to have an undercarriage 12, an overcarriage 14, and a front attachment 16. The undercarriage 12 consists basically of track and roller assemblies 18 and a carbody and swing bearing assembly 20. The overcarriage 14 of the excavator machine 10 has an engine compartment 22 which contains the prime mover engine for the machine and also contains the hydraulic system, an operator's cab 24, a platform 26, which is mounted for swingable action on the carbody and swing bearing 20, and a counterpoise 28 at the side remote from the cab 24.

The front attachment 16 of the machine 10 is formed of a dogleg boom 30 whose proximal end is mounted by means of a pivot pin 32 to the overcarriage 14. A boom cylinder 34 has a cylinder end mounted to the platform 26 and has its rod end connected to the arch of the boom 30. A coupling member 36 of a quick-disconnect coupling between the boom and stick, discussed in greater detail later, is rockably mounted at the distal end of the boom 30, and a stick cylinder 38 has a cylinder end mounted on the boom 30 and a cylinder rod coupled to a point on the boom coupling member 36 spaced from the mounting on the distal end of the boom 30.

A stick 40, here in the form of a stick shear, has its proximal end removably mounted on the boom coupling member 36, and has a shear 42 unitarily formed on its distal end. The shear 42 has a fixed jaw 44 unitarily formed with the stick 40, and has a movable jaw 46 pivotally mounted on the stick 40 to open and close to the fixed jaw 44, and which is rocked by a shear cylinder 48.

Hydraulic lines, not shown in great detail here, extend from the overcarriage 14 to the cylinders 34, 38, and 48 to effect the extension and retraction of the cylinders. These lines are fitted with quick-disconnect fittings of any conventional type.

Figure 2:
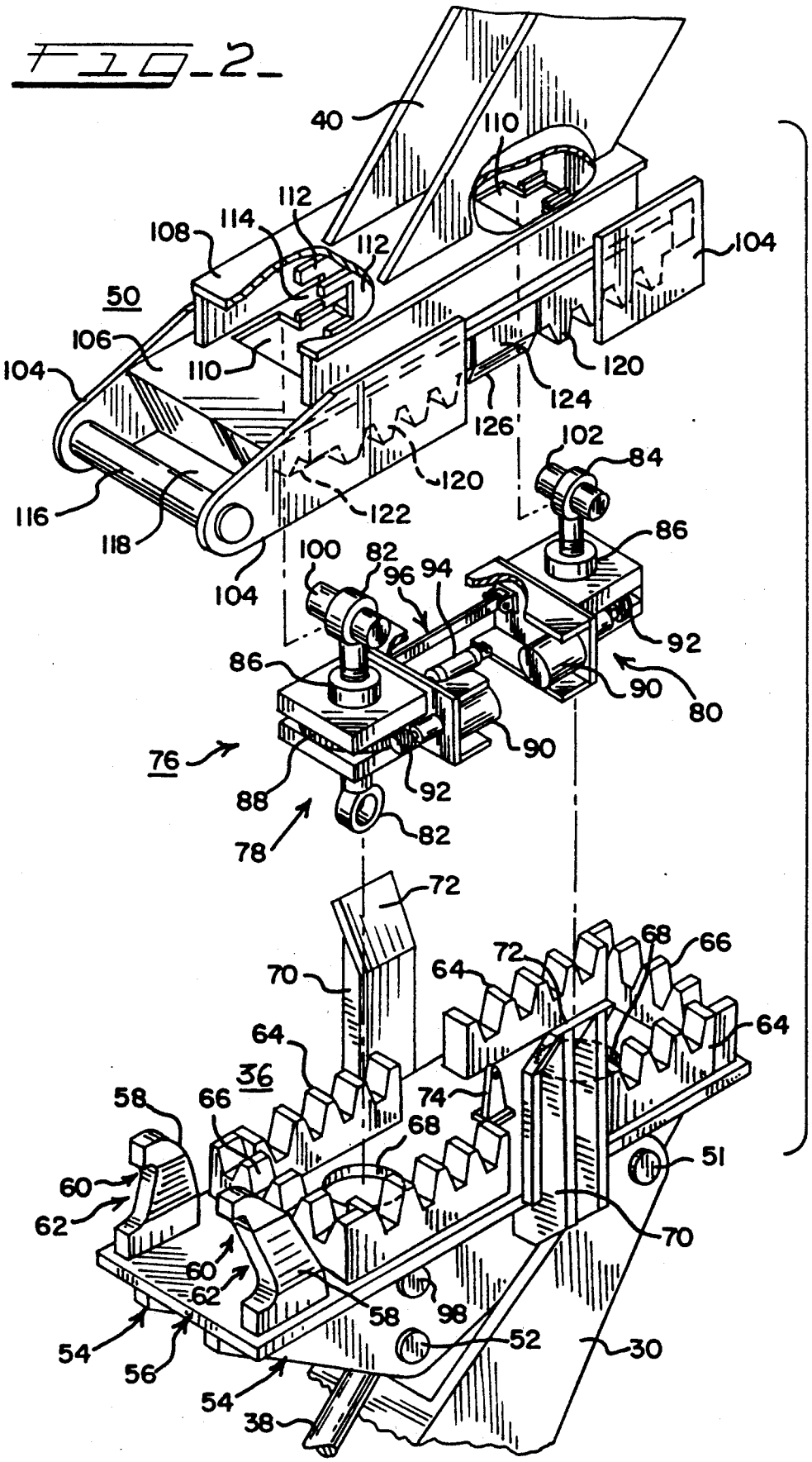
FIG. 2 is a perspective, partly exploded view of the quick-disconnect mechanism of the embodiment of FIG. 1.
Figure 3:
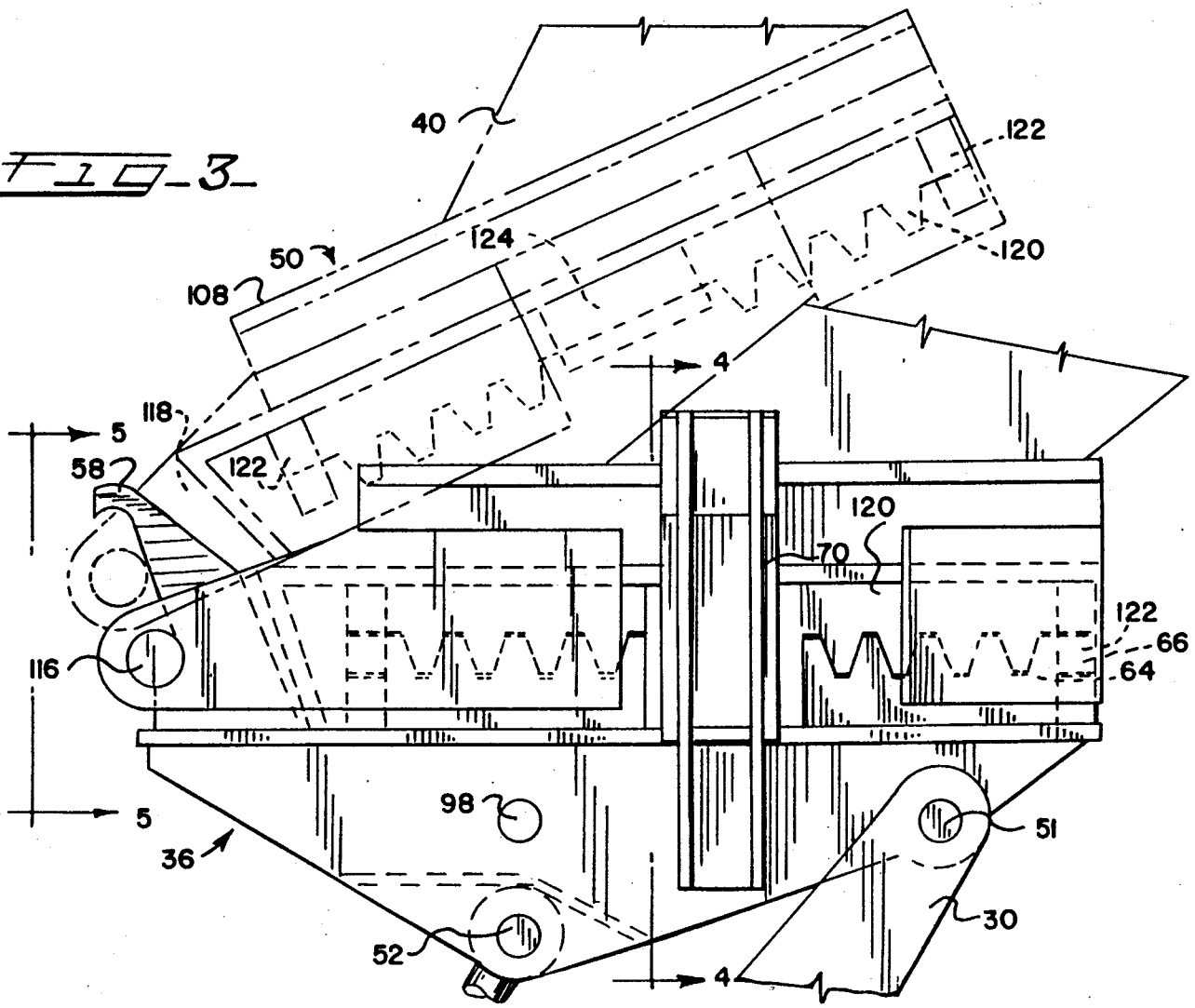
FIG. 3 is an elevational sectional view of the quick-disconnect mechanism of FIG. 1.

A coupling member 50 on the proximal end of the stick 40 permits the stick 40 to be quickly installed on or removed from the boom. As shown in FIGS. 2 and 3, the boom coupling member 36 is mounted by a pivot pin 51 to the distal end of the boom 30. The pivot pin 51 mates with a bore at the end of the boom 30, and is rotatably journalled in the coupling member 36. An eye pin 52 extends through an eye on the rod of the stick cylinder 38, and is also journalled in the coupling member 36. The coupling member 36 is formed of a pair of side wall plates 54 penetrated by the pins 51 and 52, and a main plate 56 affixed transversely thereto. A pair of grab hooks 58 are attached on the distal face of the plate 56 and towards the edge nearest which the stick cylinder 38 is connected. These grab hooks extend distally, and each has a curved hook surface 60 and a slanting slide surface 62 that extends proximally from the surface 60. The grab hooks 58 slope towards each other, as shown in FIG. 5 for more clearance at its distal end to grip the stick coupling member 50. A set of gear-tooth racks or rack gear teeth 64 are affixed onto the distal side of the main plate 56 and extend longitudinally across it, while a set of gear tooth racks 66 extend transversely thereacross. In this embodiment, the racks 64 and 66 form a quadrilateral, although other arrangements are possible within the scope of this invention.

There are clearance holes 68 in the plate 56 for accommodating a lock assembly to be described later.

A pair of female aligners 70 extend distally from opposite sides of the boom coupling member 36, and are situated about halfway from the end thereof where the grab hooks 58 are located. A cylinder mount 74 is affixed onto the plate 56 between the two clearance holes 68.

A lock assembly 76 fits onto the boom coupling member 36 and includes a front frame half 78 and a rear frame half 80. A pair of draw bolts 82 and 84 are respectively situated through the frames 78, 80, and are formed of top and bottom halves that are oppositely threaded. Respective elongated threaded nuts 86 are rotatably mounted in each of the frame halves 78, 80, and each has a rotatable worm gear 88 affixed onto its outer surface. Worm gear motors 90 are mounted on each of the frame halves 78, 80 and each drives a worm gear pinion 92 on its output shaft, the pinion 92 rotating the associated gear 88.

A lock mechanism cylinder 94 has one end attached to the front frame half 78, and another end attached to the cylinder mount 74, while a link 96 is articulated onto the two frame halves 78, 80. The front frame half bolt 82 has an eye that is journalled onto a pin 98 that extends through the shoe wall plates 54, while the other bolt 84 has a corresponding eye journaled onto the eye pin 51. The bolts 82 and 84 extend through the respective clearance holes 68. A pair of transverse pins 100 and 102 are affixed through upper eyes of the two bolt assemblies 82 and 84, and serve to engage mating structure in the stick coupling member 50. Hydraulic connections to the motors 90 and the cylinder 94 have been omitted for the sake of avoiding drawing clutter, but their connections would be apparent to those of skill in the art.

The stick coupling member 50 has a pair of elongated side plates 104 with a main plate 106 extending between them. A transverse web 108 extends between the side plates 104 above the main plate 106, and attaches to the main portion of the stick 40.

Figure 4:
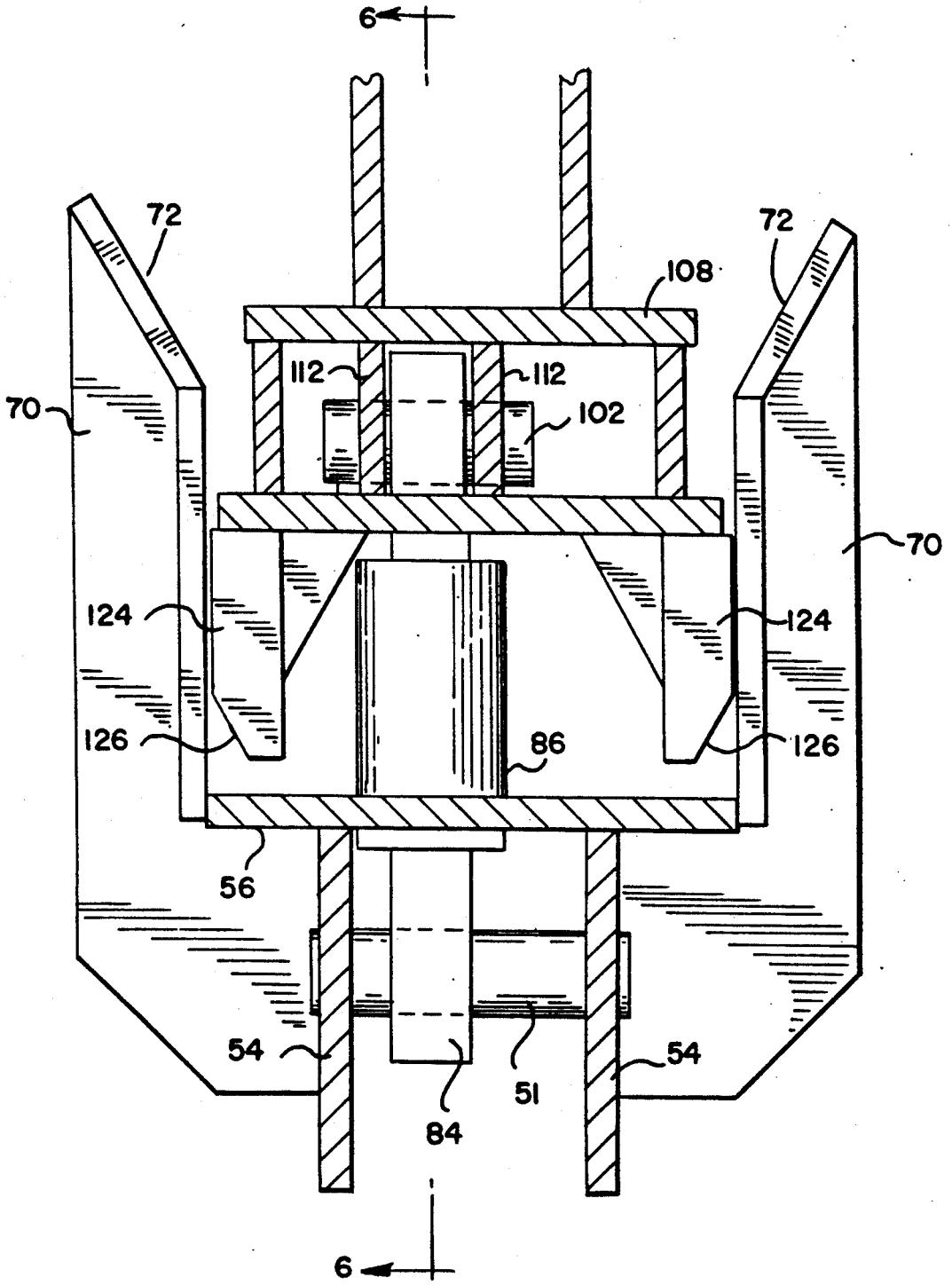
FIG. 4 is a sectional view taken at line 4—4 of FIG. 3.

A pair of T-shaped clearance holes 110 are provided to permit insertion of the pins 100, 102 of the lock assembly 76. There are a pair of parallel flanges 112 affixed to the plate 106 and web 108. As shown in FIG. 4, one of these flanges 112 can be at or near the stick center line and the other offset to one side of the stick 40. This means that the bolt assemblies 82, 84 have center lines offset from the stick center line.

Figure 6:
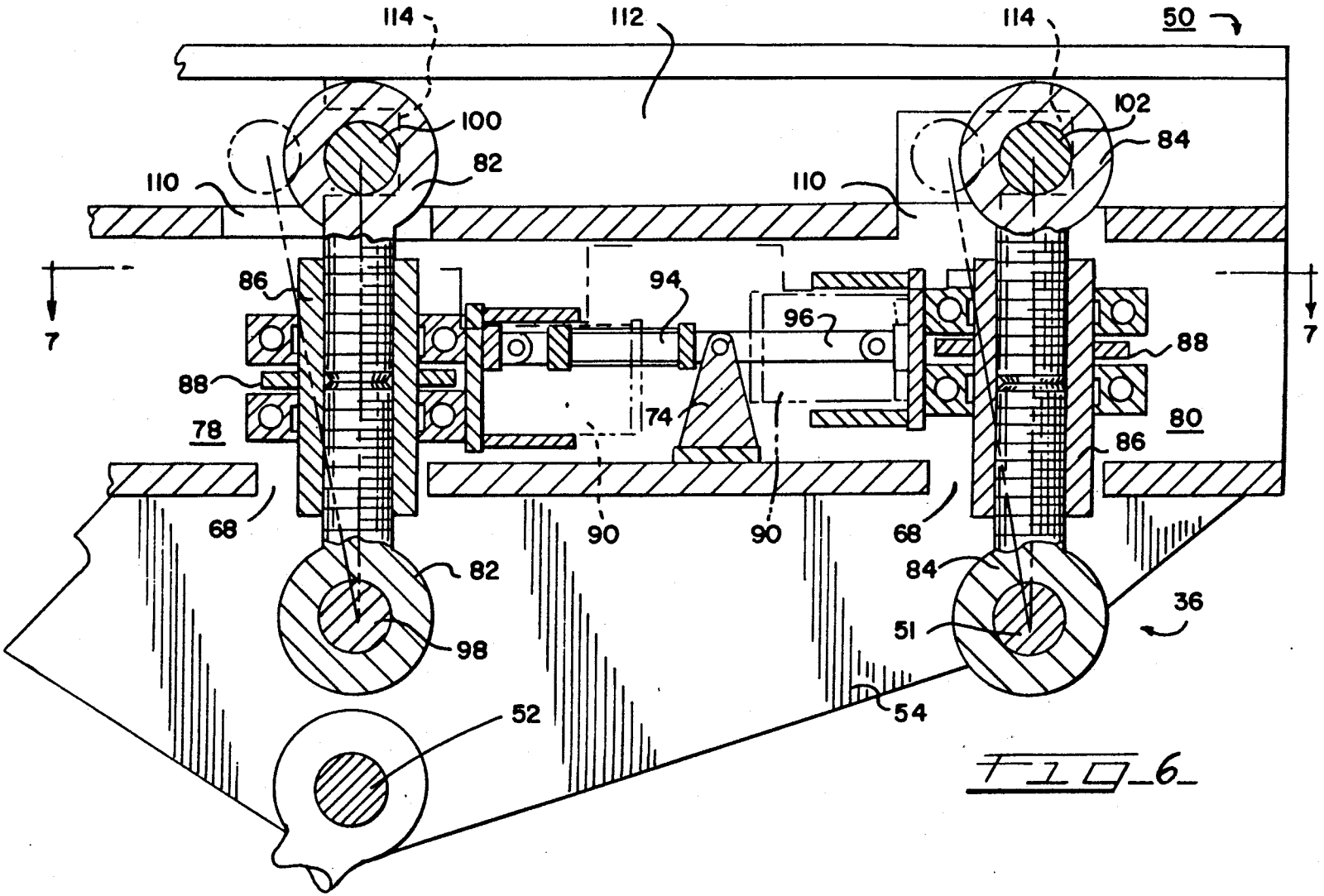
FIG. 6 is a sectional view taken along lines 6—6 of FIGS. 4 and 7.
Figure 7:
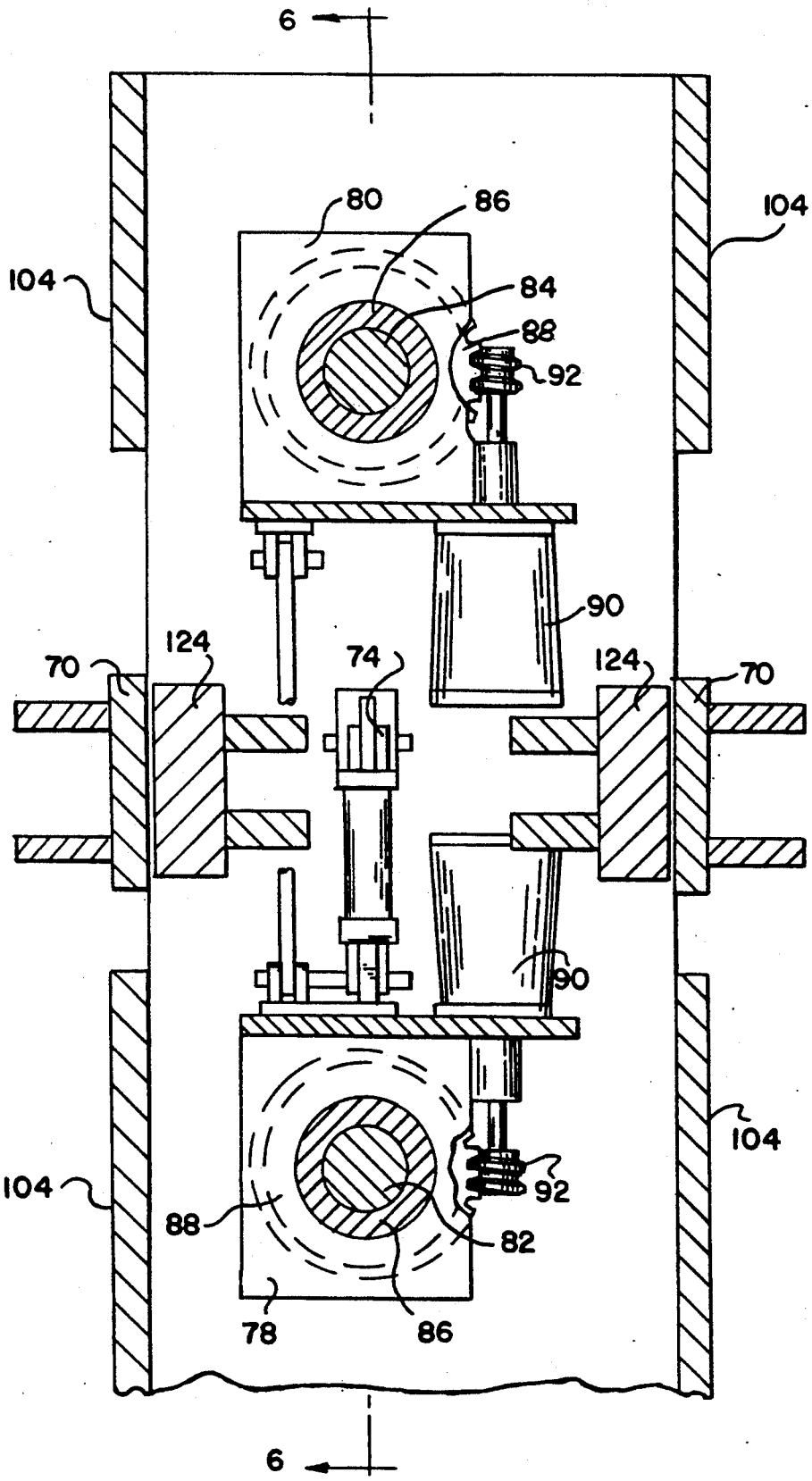
FIG. 7 is a sectional view of a portion of the quick-disconnect mechanism, taken along line 7—7 of FIG. 6.

There are a pair of longitudinal cutouts 114 in the flanges 112 to receive the pins 100, 102. Details of this are also shown in FIG. 6.

As shown in FIGS. 2 and 3, one end of each of the side plates 104 extends beyond a forward edge of the main plate 106, and a grab pin 116 is mounted between ends of the side plates 104. A clearance 118 is defined behind the grab pin 116. The grab hooks 58 of the boom member 36 fit into this clearance 118, and the grab pin 116 is received onto the hook surface 60 as indicated in ghost lines in FIG. 5.

Longitudinal gear tooth racks 120 and transverse gear tooth racks 122 are situated on the proximal surface of the main plate 106 and these mesh with the gear tooth racks 64 and 66 of the boom member 36, as indicated in solid lines on FIG. 3. As also indicated on FIGS. 2 and 3, the longitudinal racks 120 are split into front and rear halves, and a male aligner guide member 124 is affixed on each side of the plate 106 between the two halves of the associated rack 120. The aligner members 124 have beveled proximal faces 126. This means that the male members 124 are situated opposite one another on the stick coupling member 50 between the positions of the associated female aligners 70. This is shown in FIG. 4.

The quick-connect/disconnect mechanism of this invention can be explained as follows, and with reference, e.g., to FIGS. 3, 5, and 6.

When the operator desires to connect a stick onto the boom 30, the operator manipulates the boom and coupling member 36, by means of the cylinders 34 and 38, to position the grab hook 58 between the fitting side plates 104 and under the grab pin 116. The grab hooks 58 are closer together at their free ends, as shown in FIG. 5, to permit insertion when there is not good alignment, and for example, when the boom and stick are angularly related to each other. The operator can then rock the boom 30 upwards, and the grab pin comes in contact with the rounded hook surface 60. Then, as the boom is lifted, the stick 40 and the associated stick coupling member 50 swing into contact with the boom coupling member 36. Here, the beveled surfaces 126 of the male aligner guide blocks 124 meet the beveled surfaces 72 of the female aligners 70. As the stick 40 and stick coupling member 50 continue to swing downward, these aligning members 70 and 124 will straighten out the stick 40 and stick member 50 so that the teeth of the racks 64, 66 and 120, 122 can enter into intermeshing engagement. Thus, this structure permits unassisted operator hookup, even when the attachment and stick are not facing each other squarely, or are not located on level ground.

Once the grab hooks 58 and grab pin 116 and the male and female aligners 124, 70 have brought the stick member 50 into general alignment with the boom member 36, the lock assembly 76 engages the stick member 50 in the cutouts 114 and pulls the member 50 into secure engagement as shown in FIG. 3, with the teeth of the racks 64, 66 intermeshed with the teeth of the fitting racks 120, 122.

When the stick member 50 and the boom member 36 are more or less aligned, the grab pin 116 slides proximally from the curved hook surfaces 60 of the grab hooks 58 along the slanting side surfaces 62, thereby permitting the gear teeth to snap into engagement. At that point, the pins 100, 102 are in the position shown in chain in FIG. 6, i.e., with the distal eye of the bolts 82, 84 extending through the T-shaped clearance holes 110. The operator in the cab 24 can then actuate a lever to move the cylinder 94, and thereby swing the lock assembly mechanism 76 to the solid-line position of FIG. 6, with the pins 100, 102 engaging the transverse cutouts 114. The operator then actuates another lever and supplies hydraulic or electric power to the motors 90. This rotates the worm gears 88 and elongated threaded nuts 86, thereby drawing the bolt assemblies 82, 84 in the proximal direction, to lock the stick member 50 securely to the boom member 36.

The above procedure is done in reverse order to remove the stick 40 from the boom 30.

It should be appreciated that the gear-type teeth of the racks 64, 66 on the boom member 36 and of the racks 120, 122 of the stick member 50 prevent either vertical or horizontal movement as between the member 36 and the mating member 50. This eliminates all slop or play, thus eliminating any undesired wobble in the positioning of the stick 40. The gear-lock arrangement increases the reliability and positioning of the tool that is connected to the stick, usually at some distance from the boom member 36 and stick member 50, thereby promoting reliability and precision in most industrial equipment functions, such as digging, excavating, shearing, lifting, etc.

A worm gear modulating valve (not shown) can be located in the cab 24. This valve prevents overtightening and thus eliminates the possibility of stripping the threads on the bolts 82, 84 or nuts 86. The modulating valve also allows the worm gear motors 90, pinions 92, and worm gears 88 to maintain constant tension on the bolts 82, 84, so that the member 50 is held snug against the boom member 36.

The present invention has application not only to the excavator type machine illustrated in FIG. 1, but also to other machines, which can be either track or rubber tire, such as wheel loaders, track loaders, motor graders, loader backhoes, skid-steer loaders, and agricultural or industrial equipment of the type that has a boom and stick or has linkage or arms that can be adapted to operate like a boom and stick. Of course, the stick 40 can have any desired tool attached to it, such as a bucket, clam shell, stinger, dozer, impact hammer, tamper, or other tool.

Figure 8:
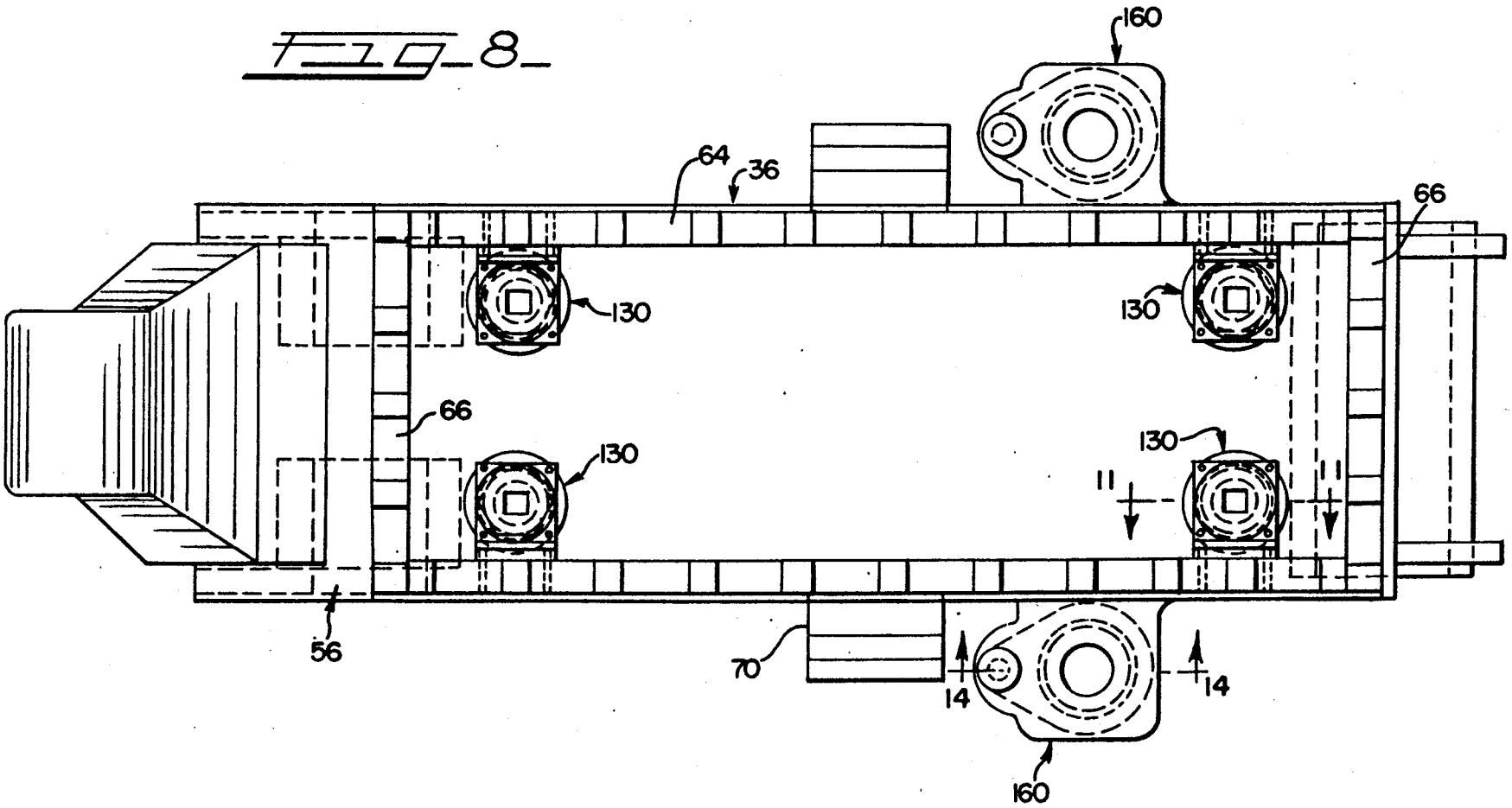
FIG. 8 is a plan view of rack gear teeth side of a modified coupling member attachable to the boom where the locking means for the coupling members differs and is in the form of bolt/nut locking devices, quick-disconnect hydraulic couplers are provided for the hydraulic lines between the boom and the stick, and the grab hook is formed of one solid piece.

Referring to FIG. 8, a further embodiment of the invention is disclosed which differs from the embodiment of FIGS. 1 to 7 in that the locking mechanism for locking the coupling members together differs from the locking mechanism of the first embodiment. Additionally, quick-disconnect hydraulic couplings are provided for automatically coupling the hydraulic lines extending between the boom and the stick together. Thus, manual interconnection of these lines is eliminated. Together with the locking mechanism for locking the coupling members together, the hydraulic couplings can also be controlled between locking and unlocking from the cab of the machine by the operator. This eliminates the need for a person to be on the ground to interconnect hydraulic lines once the coupling member has been connected. This embodiment further differs in that the grab hook of the coupling member connected to the bolt is a solid member as opposed to being constructed of a pair of arms as in the first embodiment.

Figure 9:
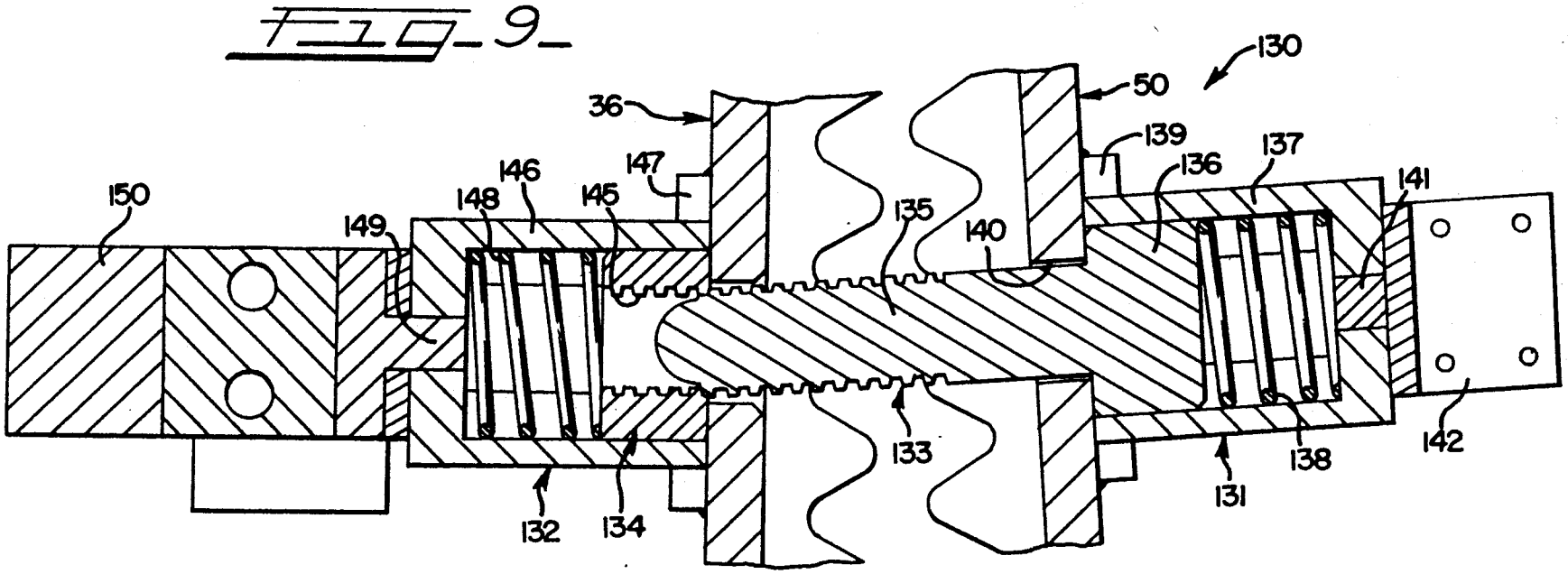
FIG. 9 is an enlarged cross-sectional view taken through parts of the coupling members and one of the bolt/nut locking devices of the embodiment of FIG. 8.

The locking mechanism in the embodiment of FIG. 8, which differs from the locking mechanism in the embodiment of FIGS. 1 to 7, includes a plurality of bolt/nut locking devices wherein the bolt is mounted on one of the coupling members of the quick-disconnect coupling of the invention and the nut is mounted on the other of the quick-disconnect coupling members of the coupling of the present invention. While any number of bolt/nut devices may be used, preferably four such devices are employed, one in each of the four corners of the coupling members near the pin connections to the boom and stick, as seen particularly in FIG. 8. These locking devices are generally indicated by the numeral 130 and are more particularly illustrated in FIGS. 9, 10 and 11. Each locking device includes a male coupling element 131 and a female coupling element 132. Preferably, the male coupling unit is mounted on the stick coupling member 50, while the female coupling is mounted on the boom coupling unit 36. Further, the male coupling element 131 includes a bolt 133, while the female locking element 132 includes a nut 134. The bolt 133 includes a threaded shank 135 and a hex-in-cross-section-shaped head 136. The hex head 136 is received in a socket 137 to prevent it from rotating and is spring-biased by a spring 138 toward the nut 134. The socket 137 is mounted on the back side of the stick coupling member 50 and oriented by means of a ring 139 welded to the coupling member. An opening 140 is provided in the coupling member through which the shank 135 of the bolt 133 extends. A drive member 141 is provided for the socket 137 and anchored to a bracket 142 which in turn is connected to the stick coupling member 50 in a suitable manner. Thus, the head of the bolt 136 engages the spring 138 which bottoms in the socket 137, and the spring causes the bolt 133 to be continually urged against the coupling member 50.

The female locking element 132, which includes the nut 134, is mounted on the boom coupling member 36 in an aligned position with the male locking element 131, so that the bolt 133 can engage the nut 134. The nut 134 includes an internal thread 145 which threadingly mates with the threads on the bolt 133, and the nut is spring-biased within a socket 146 against the boom coupling member 136. The socket 146 is guidably received in the ring guide 147 and includes interiorly a spring 148 for spring-biasing the nut against the boom coupling member 36. Both ring guides 139 and 147 are suitably secured to the respective coupling members and preferably by welding. A drive 149 engages the socket 146 and the drive is connected to a motor 150 that may be remotely operated by the operator in the cab of the machine. The motor 150 is suitably mounted on the boom coupling member 36. While the nut socket 146 is shown to be rotatably driven by the motor 150 and the socket 137 for the bolt is fixed against rotation, it could be appreciated that the nut socket could be fixed against rotation and the bolt socket could be mounted for rotation. It is not necessary to have both sockets mounted for rotation, and it is more convenient to have the socket on the boom coupling member driven by the motor to always maintain a connection to the motor and the cab.

Figure 10:
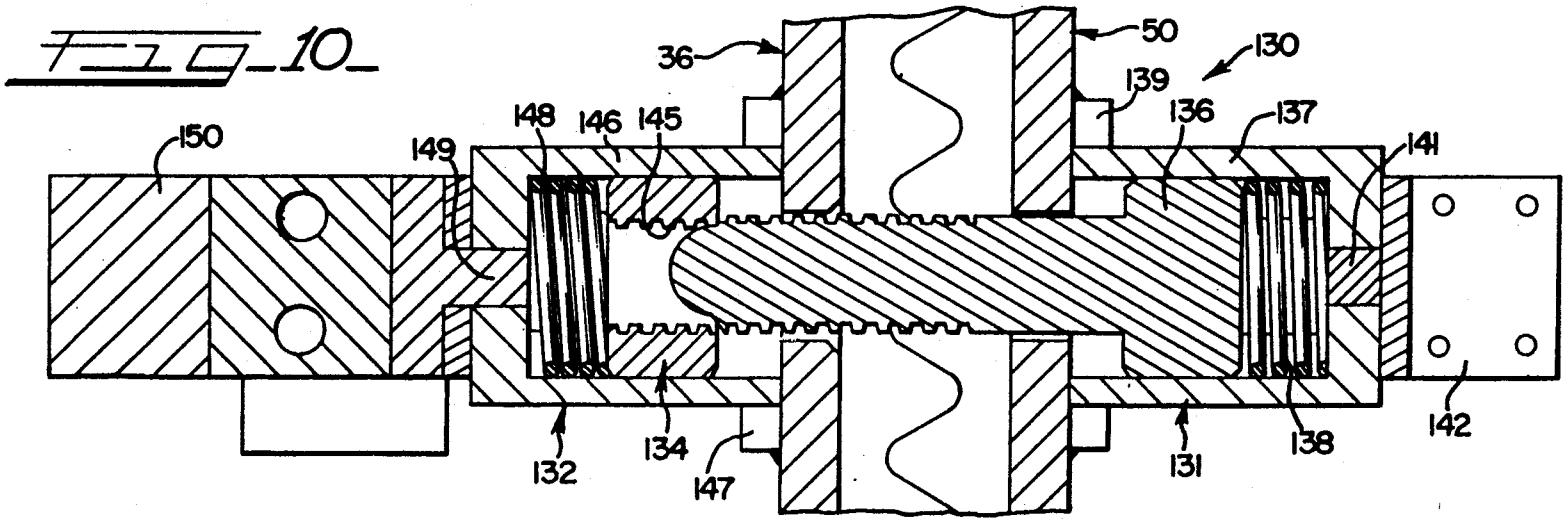
FIG. 10 is a view similar to FIG. 9 but showing the coupling members in engaged position and the positions of the bolt and nut of the locking device prior to threading the bolt into the nut.
Figure 11:
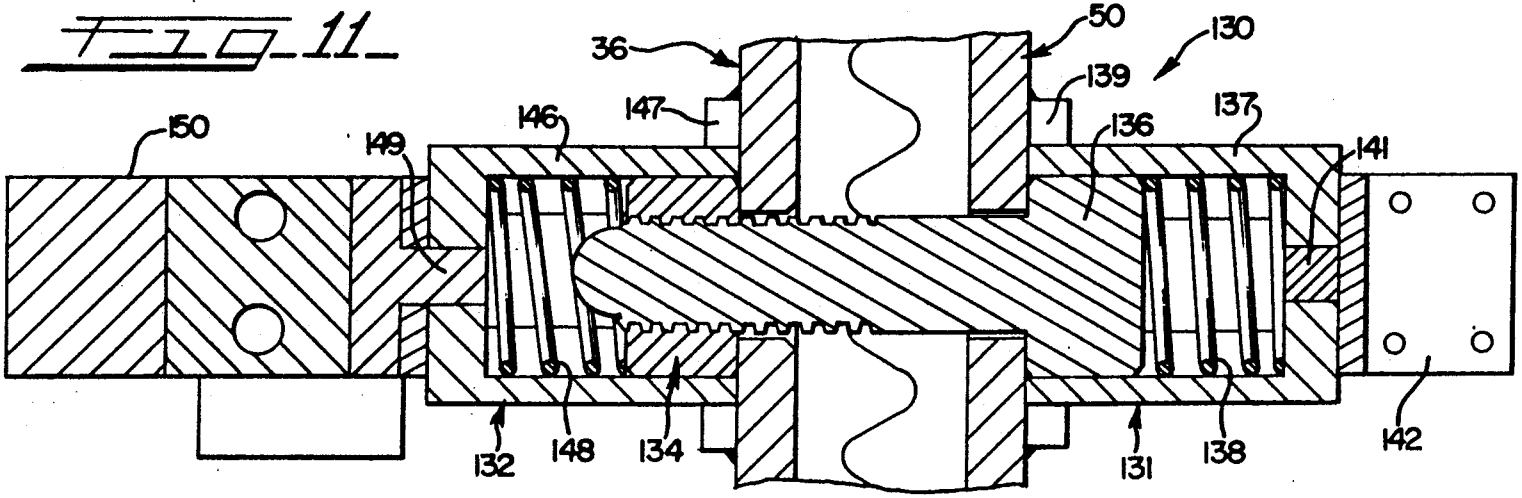
FIG. 11 is a view like FIG. 10 except that the nut has been threaded into the bolt to tightly secure the two coupling members together.

In operation, each of the locking devices will, by virtue of the spring-mounting of the nuts and bolts, absorb any shock during interengagement of the coupling members, and as shown in FIG. 10, when the coupling members are brought together, the bolt 133 will properly align with the nut 134, and both the nut and bolt will be slightly depressed against the respective springs prior to the interconnection of the bolt and nut. The spring-biased nut and bolt elements absorb any shock that may be incurred during the joining and interengagement of the coupling members. Once the coupling members are together, as shown in FIG. 10, the motor 150 can be operated to screw the nut tightly on the bolt as shown in FIG. 11 to tightly interlock the two coupling members.

Because of the interengagement between the grab hook and the grab pin at the one end of the quick-disconnect coupling, it could be appreciated that there may need to be only a pair of locking devices at the other ends of the coupling members away from the grab hook and grab pin locations. However, for purposes of providing an absolute safe and tight connection, the locking mechanism preferably includes four locking devices, as illustrated in FIG. 8. It will also be noted that the locking devices are located closely adjacent to the pin connections of the coupling members to the respective boom and stick where the maximum stress is involved in the operation of the machine.

It will be appreciated that this engagement of the coupling members and separation of the coupling members can easily be accomplished where the locking devices are operated to turn on and turn off the nut from the bolt. It will also be appreciated that any other suitable arrangement of locking device location may be used which will provide the necessary locking action to prevent separation of the coupling members during operation of the machine.

Another unique feature of the embodiment of FIG. 8 is the provision of quick-disconnect hydraulic couplings for connecting and disconnecting the hydraulic lines between the boom and the stick. As already mentioned, the stick would normally have a working member requiring the use of a hydraulic cylinder, and it is necessary therefore to have an interconnection of the hydraulic lines for that cylinder to hydraulic lines coming from the machine off the boom. While these are not illustrated specifically in the main drawings, it will be appreciated that the hydraulic lines coming from the boom will provide a source of hydraulic power to the hydraulic cylinder on the stick.

Figure 12:
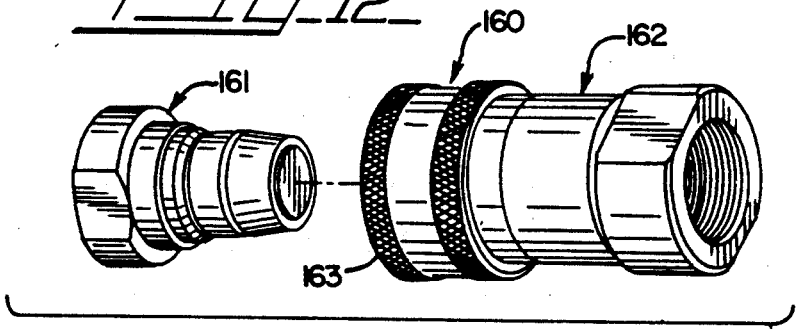
FIG. 12 is a perspective view of one of the quick-disconnect hydraulic couplings for the hydraulic lines between the boom and stick and as illustrated in the embodiment of FIG. 8.
Figure 13:
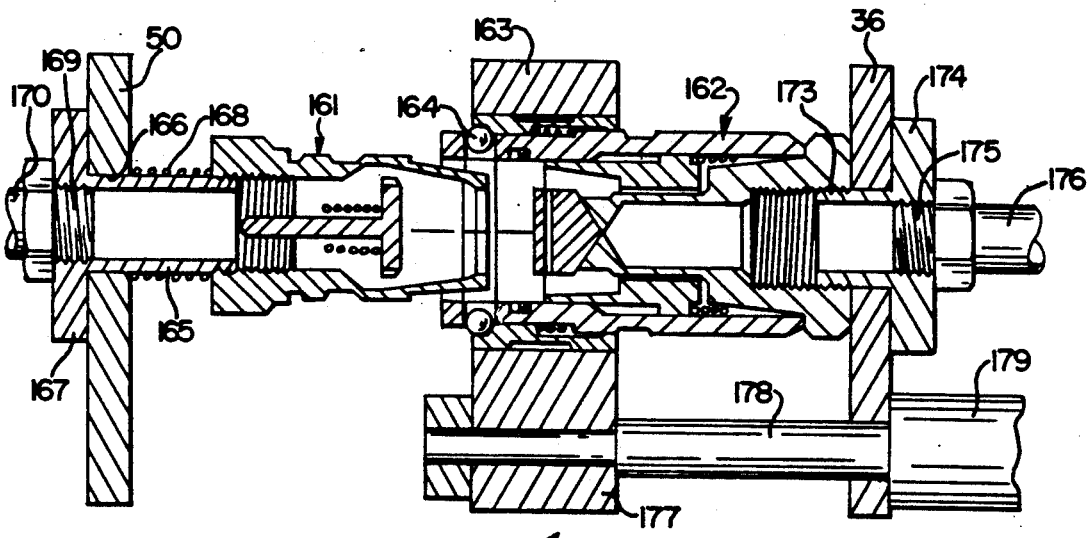
FIG. 13 is a detailed sectional view of the quick-disconnect hydraulic coupling as mounted on the coupling members in disassembled relation and showing the locking ring or sleeve in retracted unlock position.
Figure 14:
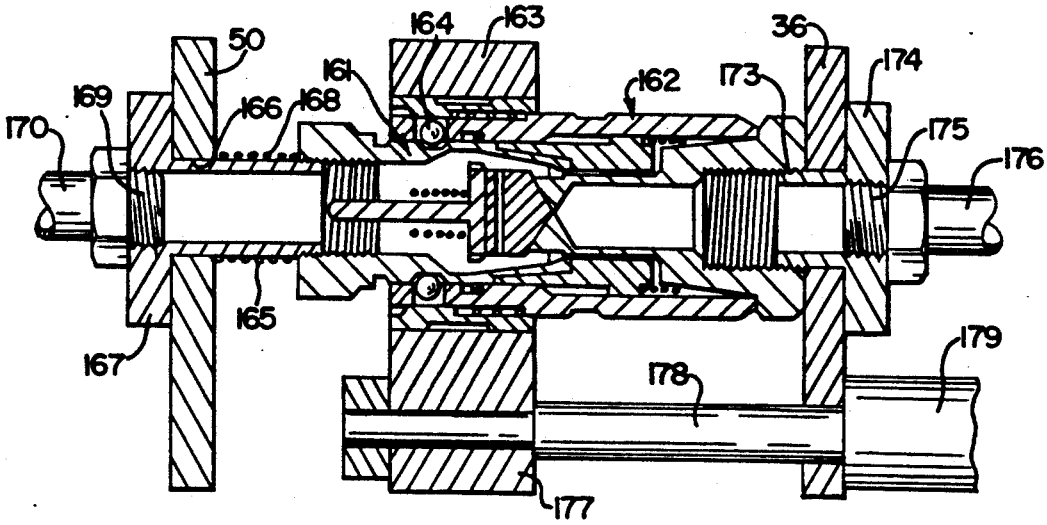
FIG. 14 is a detailed sectional view similar to FIG. 13 but illustrating the hydraulic coupling in coupled relation.
Figure 15:
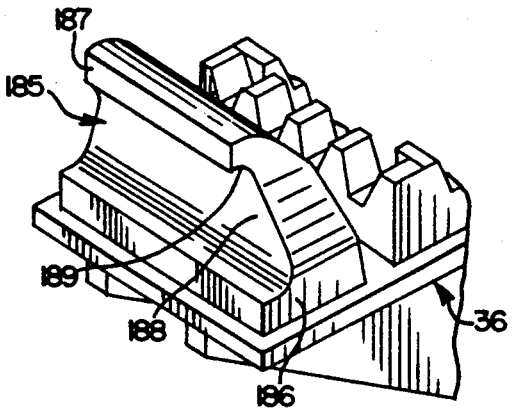
FIG. 15 is a fragmentary perspective view of the solid grab hook of the embodiment of FIG. 8.
Figure 17:
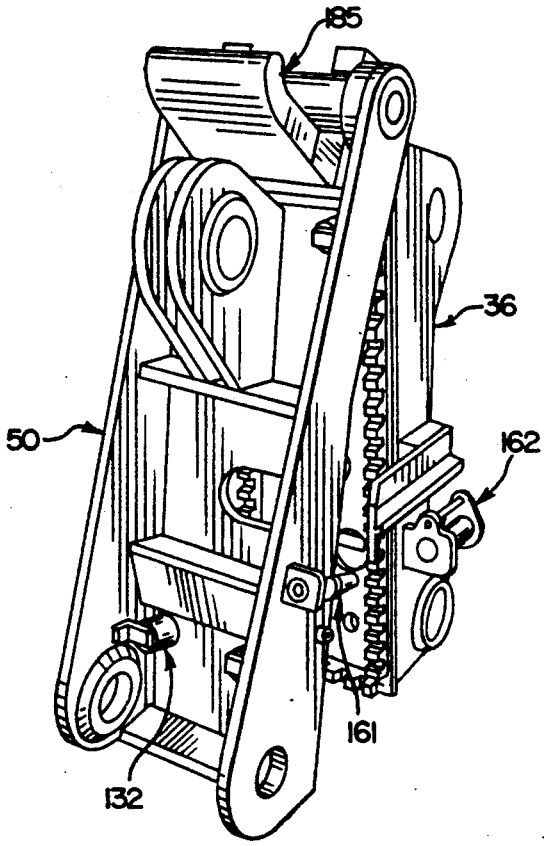
FIG. 17 is an upright perspective view of the embodiment of FIG. 8 illustrating the coupling members in separated position.
Figure 16:
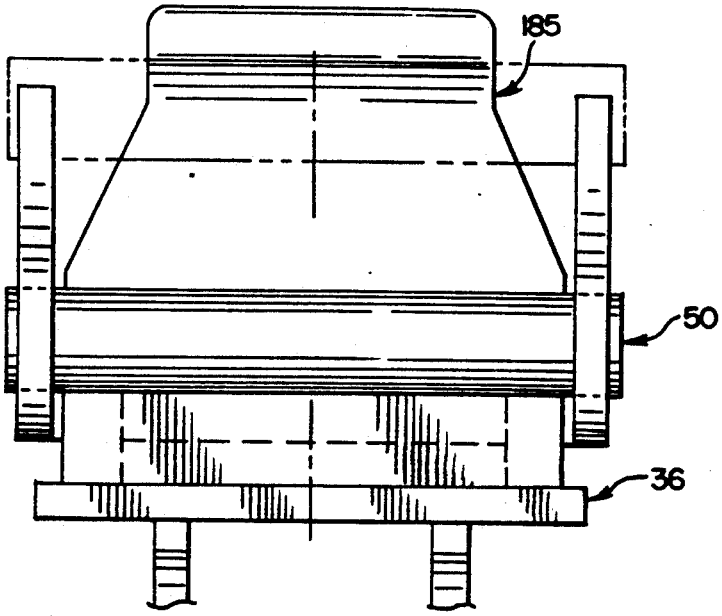
FIG. 16 is an end view of the grab hook in engaged position with the grab pin.

Referring now particularly to FIGS. 12, 13 and 14, a quick-disconnect hydraulic coupling 160 includes a male coupling element 161 and a female coupling element 162. As seen particularly in FIGS. 8 and 17, the hydraulic couplings 160 are mounted on the outside of the coupling members and closer to the end opposite the grab pin ends of the coupling members. While a pair of hydraulic couplings is provided, it will be appreciated that any number of hydraulic couplings may be provided in order to properly handle the hydraulic cylinders on the stick. Normally, only one double-acting hydraulic cylinder is provided on the stick, and therefore only two hydraulic couplers need be provided to handle the two hydraulic lines going to the cylinder. It will be appreciated that the actual hydraulic coupling elements 161 and 162, as shown specifically in FIG. 12, are a manufactured coupling by Snap-Tite as a Series 71 coupling. This quick-disconnect coupling includes the male element 161 and the female element 162 which has a locking ring 163. The locking ring is shown in retracted position in FIG. 13, where the ball locking members 164 are allowed to float so that the male coupling member can be either separated from or inserted into the female coupling element 162. The locking sleeve 163 therefore must be actuated for disconnection and connection of the quick-disconnect coupling.

The male coupling element 161 is threadedly engaged on a pipe 165 which is freely received in an opening 166 of the stick coupling member 50. The outer end of the pipe 165 includes a flange 167 which functions with the spring 168 to normally maintain the male coupling element 161 in the position shown in FIG. 13. When the two coupling members are brought together and prior to locking of the two coupling elements together, the spring mount of the male coupling element prevents any damage to the coupling elements in the event that they are brought together prior to the operation of the locking ring 163. A fitting 169 for the hydraulic line 170 is threadedly received by the flange pipe 167. This hydraulic line would go to a working cylinder on the stick.

The female coupling element 162 is threadedly connected to a pipe 173 having a flanged end 174 and being mounted on the boom coupling member 36. A fitting 175 for the boom hydraulic line 176 connects the boom hydraulic line to the pipe 173 of the female coupling element 162. The lock ring 163 includes an extension 177 connecting to a piston rod 178 of a hydraulic cylinder 179 mounted on the boom coupling member 36. The cylinder 179 would be suitably operated from the cab of the machine to place the locking ring into lock and unlock positions as desired during the locking together of the hydraulic coupling and the disconnection of the hydraulic coupling.

Thus, as the male and female hydraulic coupling elements come together, the locking ring 163 would be actuated in order to lock the coupling elements together so that the hydraulic lines between the boom and stick can be interconnected without the need of a manual connection procedure. Thus the operator of the cab can not only interchangeably connect the stick on his boom by himself but he also can interconnect the hydraulics for a working cylinder on the stick. The arrangement not only eliminates the necessity of a person on the ground to handle the interconnection of the hydraulic lines but also promotes safety in that it is not necessary to use a person on the ground for connection of the coupling members and the hydraulic lines, thereby eliminating the potential of accidental injury of the person on the ground.

It will be appreciated that preferably the female coupling element of the hydraulic coupling be mounted on the boom coupling member because of the need to have an active cylinder for operating the locking ring. However, if this was not an important factor, the female coupling element could be mounted on the stick coupling member and the male coupling element could be mounted on the boom coupling member.

The embodiment of FIG. 8 also differs from the embodiment of FIGS. 1 to 7 in that the grab hook is solid or one-piece. As seen in FIGS. 8 and 15 to 17, the single piece grab hook is generally designated by the numeral 185 and includes a solid base 186 of a greater width than the hook end 187. A slanting surface 188 compares with the slanting slide surfaces 62 on the grab hooks 58 of the embodiment of FIGS. 1 to 7. Similarly, the grab hook 185 includes a hook surface 189 that is comparable to the hook surface 60 of the grab hooks of the first embodiment. As seen particularly in FIG. 16, the free end of the grab hook 185 is much narrower than at its base so that it will function similarly to the grab hook arms in the embodiment shown in FIG. 5; that is, if the stick and boom coupling members are angularly related to each other and not perfectly aligned, the grab hook can engage the grab pin where after the boom would be manipulated in order to free up the stick so that it could swing into alignment and allow the two coupling members to properly come together for locking the stick to the boom. The narrower outer end is easier to enter the opening by the grab pin and the wider base guides the stick coupling member into alignment with the boom coupling member so the rack gear teeth can properly intermesh.

It will be understood that modifications and variations may be effected without departing from the scope of the novel concepts of the present invention, but it is understood that this application is to be limited only by the scope of the appended claims.

The invention is hereby claimed as follows:

1. In a machine adapted for heavy work including a boom, a stick having a tool for performing heavy work and including a hydraulic working cylinder having at least one hydraulic line extending therefrom, at least one hydraulic power line on the boom for connection to the hydraulic line on the stick, means for driving the boom and stick, and a quick disconnect coupling between the boom and stick to permit a quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to tightly interfit with elements of like shape on said male member, said intermeshing elements extending generally vertically from the base and toward the elements of like shape as the members come together and being arranged to inhibit both longitudinal and transverse movement between the male and female members, said intermeshing elements and elements of like shape further including a plurality of slanting flat surfaces, the slanting surfaces of the elements on one member mating with slanting surfaces of the elements on the other member, some of said slanting surfaces slanting in one direction from the vertical and other of said slanting surfaces slanting in another direction relative to the vertical, at least some of the slanting surfaces on each member being angularly turned relative to other of said slanting surfaces on said member, remotely operable locking means on said members for positively locking the members together to maintain said intermeshing elements locked tightly together, and a quick-disconnect hydraulic coupling including a male coupling element and a female coupling element, one of said coupling elements fixedly mounted on one of said members and the other fixedly mounted on the other of said members such that when the members are together in engaging relation the coupling elements will couple, the coupling element on the stick being connected to the hydraulic line for the cylinder and the coupling element on the boom being connected to the boom hydraulic line.

2. The machine of claim 1, wherein said male member includes a pin for coacting with said grab hook means and aligning means coacting with the aligning means on the female member, and intermeshing elements which comprise the elements of like shape for meshing with the intermeshing elements of said female member.

3. The machine of claim 2, wherein said intermeshing elements of each member includes rack gear teeth.

4. The machine of claim 3, wherein the grab hook means includes a solid hook member extending from the base shaped to have the outer end narrower than the inner end so that the hook member can engage the pin in the event the pin extends at an angle to the hook member.

5. The machine of claim 3, wherein the aligning means of said members engage to align the members prior to engagement of said rack gear teeth.

6. The machine of claim 4, wherein said aligning means is arranged to be able to engage after engagement of said grab hook member and pin, and before engagement of said rack gear teeth.

7. The machine of claim 2, wherein said grab hook means includes cam means coacting with said pin for aligning the members in end-to-end relation.

8. The machine of claim 7, wherein said aligning means includes means for aligning said members in side-to-side relation.

9. The machine of claim 3, wherein said grab hook means and pin coact with said aligning means to precisely align the members so the rack gear teeth will mesh when the members are in coupled relation.

10. The machine of claim 3, wherein said rack gear teeth include a plurality of teeth, at least some of which are disposed at angles relative to others.

11. In a machine adapted for heavy work including a boom, a stick having a tool for performing heavy work and including a hydraulic working cylinder having at least one hydraulic line extending therefrom, at least one hydraulic power line on the boom for connection to the hydraulic line on the stick, means for driving the boom and stick, and a quick disconnect coupling between the boom and stick to permit quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to closely interfit with like elements on said male member, said male member including a pin for coacting with said grab hook means, aligning means coating with the aligning means on the female member, intermeshing elements for meshing with the intermeshing elements of said female member, said intermeshing elements including rack gear teeth which include a plurality of rows of teeth and at least one row extending at an angle to another row, said intermeshing elements being arranged to inhibit both longitudinal and transverse movement between the male and female members, remotely operable locking means on said members for positively locking the members together to maintain said intermeshing elements locked tightly together, and a quick-disconnect hydraulic coupling including a male coupling element and a female coupling element, one of said coupling elements fixedly mounted on one of said members and the other fixedly mounted on the other of said members such that when the members are together in engaging relation the coupling elements will couple, said female coupling element including locking means for locking the coupling elements together, and remotely operated means for actuating the locking means during coupling and uncoupling, the coupling element on the stick being connected to the hydraulic line for the cylinder and the coupling element on the boom being connected to the boom hydraulic line.

12. In a machine adapted for heavy work including a boom, a stick having a tool for performing heavy work and including a hydraulic working cylinder having at least one hydraulic line extending therefrom, at least one hydraulic power line on the boom for connection to the hydraulic line on the stick, means for driving the boom and stick, and a quick disconnect coupling between the boom and stick to permit quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to closely interfit with like intermeshing elements on said male member, said male member including a pin for coacting with said grab hook means, aligning means coacting with the aligning means on the female member, like intermeshing elements for meshing with the intermeshing elements of said female member, said intermeshing elements and like elements including rack gear teeth which include a plurality of rows of teeth and at least one row extending at a right angle to another row, said intermeshing elements and like elements being arranged to inhibit both longitudinal and transverse movement between the male and female members, remotely operable locking means on said members for positively locking the members together to maintain said intermeshing elements tightly locked together, and a quick-disconnect hydraulic coupling including a male coupling element and a female coupling element, one of said coupling elements fixedly mounted on one of said members and the other fixedly mounted on the other of said members such that when the members are together in engaging relation the coupling elements will couple, said female coupling element including locking means for locking the coupling elements together, and remotely operated means for actuating the locking means during coupling and uncoupling, the coupling element on the stick being connected to the hydraulic line for the cylinder and the coupling element on the boom being connected to the boom hydraulic line.

13. The machine of claim 12, wherein the grab hook means includes a pair of hook members extending from the base such as to be able to engage and coact with said pin prior to engagement of said aligning means and said rack gear teeth.

14. The machine of claim 11, wherein the grab hook means includes a solid member extending from the base such as to be able to engage and coact with said pin prior to engagement of said aligning means and said rack gear teeth.

15. In a machine adapted for heaving work including a boom, a stick having a tool for performing heavy work, means for driving the boom and stick, and a quick disconnect coupling between the boom and stick to permit quick interchanging of sticks, the improvement in the coupling which comprises a male member attached to one of the boom or stick and a female member attached to the other of the boom or stick, said male member comprising a base and said female member comprising a base, grab hook means on one end, intermeshing elements on said female member adapted to tightly interfit with intermeshing elements of like shape on said male member, said intermeshing elements extending generally vertically from each base and toward each other as the members come together and being arranged to inhibit both longitudinal and transverse movement between the male and female members, said intermeshing elements further including a plurality of slanting flat surfaces, the slanting surfaces of intermeshing elements on one member mating with slanting surfaces of intermeshing elements on the other member, some of said slanting surfaces slanting in one direction from the vertical and other of said slanting surfaces slanting in another direction relative to the vertical, at least some of the slanting surfaces on each member being angularly turned relative to other of said slanting surfaces on said member, remotely operating locking means on said members for positively locking the members together to maintain said intermeshing elements locked tightly together, said male member including a pin for coacting with said grab hook means, and said grab hook means including a solid hook member extending from the base shaped to have the outer end narrower than the inner end so that the hook member can engage the pin in the event the pin extends at an angle to the hook member.

16. The machine of claim 15, wherein said grab hook means includes cam means coacting with said pin for aligning the members in end-to-end relation.

17. The machine of claim 15, wherein said grab hook means and pin coact with said aligning means to precisely align the members so the rack gear teeth will mesh when the members are in coupled relation.

18. In a machine adapted for heavy work including a boom, a stick having a tool for performing heavy work, means for driving the boom and stick, and a quick disconnect coupling between the boom and stick to permit quick interchanging of sticks, the improvement in the coupling which comprises a male member attached to one of the boom or stick, and a female member attached to the other of the boom or stick, said female member comprising a base, grab hook means on one end, said male member including a pin coacting with said grab hook means, said grab hook means including a substantially tapered solid hook member extending from the base, said hook member including an inner portion connected to the base and an outer portion extending from the inner portion, said outer portion being narrower than said inner portion so that the hook member can engage the pin in the event the pin extends at an angle to said hook member, aligning means intermediate the ends of the base for guiding alignment of the female member, intermeshing elements on said female member adapted to closely interfit with like elements on said male member, said male member further including aligning means coacting with the aligning means on the female member, and intermeshing elements for meshing with the intermeshing elements of said female member, said intermeshing elements of both members including rack gear teeth which include a plurality of rows of teeth and at least one row extending at an angle to another row and being arranged to inhibit both longitudinal and transverse movement between the male and female members, and remotely operable locking means on said members for positively locking the members together to maintain said intermeshing elements locked tightly together.

19. The machine of claim 1, wherein the female coupling element of the hydraulic coupling includes locking means for locking the coupling elements together.

20. The machine of claim 19, which further includes remotely operated means for actuating the locking means during coupling and uncoupling.

21. The machine of claim 15, wherein the coupling further includes aligning means on the male member intermediate the ends of the base for guiding alignment of the female member when they come together.

* * * * *